US008789580B2

(12) United States Patent
Dancer et al.

(10) Patent No.: US 8,789,580 B2
(45) Date of Patent: Jul. 29, 2014

(54) WELLBORE CASING SECTION WITH MOVEABLE PORTION FOR PROVIDING A CASING EXIT

(75) Inventors: William Wallace Dancer, Denton, TX (US); Stacey Blaine Donovan, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/879,689

(22) PCT Filed: Apr. 30, 2012

(86) PCT No.: PCT/US2012/035754

§ 371 (c)(1),
(2), (4) Date: Apr. 16, 2013

(87) PCT Pub. No.: WO2013/165342

PCT Pub. Date: Nov. 7, 2013

(65) Prior Publication Data

US 2014/0008130 A1 Jan. 9, 2014

(51) Int. Cl.
*E21B 7/06* (2006.01)
*E21B 23/12* (2006.01)

(52) U.S. Cl.
CPC ..... *E21B 7/06* (2013.01); *E21B 23/002* (2013.01)
USPC ..... 166/117.5; 166/117.7; 166/242.1

(58) Field of Classification Search
CPC ..... E21B 7/06; E21B 7/061; E21B 23/002
USPC ..... 166/117.5, 117.6, 117.7, 242.1, 237; 175/61
See application file for complete search history.

(56) References Cited

U.S. PATENT DOCUMENTS

| | | | | |
|---|---|---|---|---|
| 61,726 | A * | 2/1867 | Edgett | 175/22 |
| 2,797,893 | A * | 7/1957 | McCune et al. | 166/381 |
| 5,458,209 | A * | 10/1995 | Hayes et al. | 175/61 |
| 5,579,829 | A * | 12/1996 | Comeau et al. | 166/117.6 |
| 6,029,747 | A * | 2/2000 | Morrell et al. | 166/313 |
| 6,095,248 | A * | 8/2000 | Freeman | 166/313 |
| 6,354,375 | B1 * | 3/2002 | Dewey | 166/313 |
| 6,899,186 | B2 | 5/2005 | Galloway et al. | |
| 2003/0141063 | A1 * | 7/2003 | Haugen et al. | 166/297 |
| 2003/0196819 | A1 | 10/2003 | Coon | |
| 2009/0255687 | A1 | 10/2009 | McCullough et al. | |
| 2010/0294512 | A1 | 11/2010 | Assal et al. | |
| 2013/0284458 | A1 | 10/2013 | Dancer et al. | |

OTHER PUBLICATIONS

International Search Report and Written Opinion for PCT/US2012/035754 dated Feb. 18, 2013.

* cited by examiner

*Primary Examiner* — Kenneth L Thompson
(74) *Attorney, Agent, or Firm* — McDermott Will & Emery LLP; Anthony Iannitelli

(57) ABSTRACT

Systems and methods for providing a casing exit include a casing section having a generally cylindrical outer sleeve including a proximal end and a distal end. The outer sleeve may define an outer window extending between the proximal end and the distal end. A generally cylindrical inner sleeve may be received within the outer sleeve and may define an inner window. The inner sleeve may be moveable between a first position in which the inner window is misaligned with the outer window and the inner sleeve substantially closes the outer window, and a second position in which the inner window is aligned with the outer window. A deflector tool may be configured to engage the inner sleeve and move the inner sleeve from the first position to the second position.

15 Claims, 12 Drawing Sheets

WELLBORE CASING SECTION WITH MOVEABLE PORTION FOR PROVIDING A CASING EXIT

CROSS-REFERENCE TO RELATED APPLICATIONS

The present application is a National Stage entry of and claiming priority to International Application No. PCT/US2012/035754 filed on Apr. 30, 2012.

BACKGROUND

The present invention relates generally to providing a casing exit for a lateral borehole, and more particularly to systems and methods for providing a casing exit with little or no milling of the casing.

Hydrocarbons can be produced through relatively complex wellbores traversing a subterranean formation. Some wellbores can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first general direction and a secondary wellbore diverted from the main wellbore in a second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either multilateral or sidetrack wellbores can be formed by positioning a casing joint and a whipstock in a casing string at a desired location in the main wellbore. The whipstock is used to deflect one or more mills laterally (or in an alternative orientation) relative to the casing string. The deflected mill(s) machines away and eventually penetrates part of the casing joint to form the casing exit in the casing string. Drill bits can be subsequently inserted through the casing exit in order to cut the lateral or secondary wellbore.

Milling the casing exit is a time consuming and potentially harmful process. Milling away the material of the casing creates highly abrasive metallic chips that can cause significant wear on equipment located in the wellbore during the milling process and on equipment that subsequently passes through the area in which the milling takes place. Furthermore, because the mill is only used for milling the casing exit, several trips down the wellbore are required before commencing actual drilling of the associated lateral wellbore.

SUMMARY OF THE INVENTION

The present invention relates generally to providing a casing exit for a lateral borehole, and more particularly to systems and methods for providing a casing exit with little or no milling of the casing.

In some embodiments, a casing section is disclosed for positioning in a wellbore at a location where it is desired to form a diverging lateral borehole. The casing section may include a generally cylindrical outer sleeve including a proximal end and a distal end. The outer sleeve may define an outer window extending between the proximal end and the distal end. A generally cylindrical inner sleeve may be received within the outer sleeve and may define an inner window. The inner sleeve may be moveable between a first position in which the inner window is misaligned with the outer window and the inner sleeve substantially closes the outer window, and a second position in which the inner window is aligned with the outer window.

In other embodiments, a drilling system is disclosed for forming a lateral borehole that diverges away from a wellbore. The drilling system may include a casing string extended within the wellbore and including a casing section having an outer sleeve and an inner sleeve rotatably received within the outer sleeve. The outer sleeve may include an outer sleeve wall defining an outer window that opens into the wellbore. The inner sleeve may include an inner sleeve wall defining an inner window. The inner sleeve may be rotatable with respect to the outer sleeve from a closed configuration in which the inner window is rotationally misaligned with the outer window and the inner sleeve wall substantially closes the outer window, to an open configuration in which the inner window is substantially rotationally aligned with the outer window. The inner sleeve may include a first alignment portion engageable to rotate the inner sleeve with respect to the outer sleeve. A deflector tool may be positionable at least partially within the casing section. The deflector tool may include a deflector surface and a second alignment portion engageable with the first alignment portion to rotate the inner sleeve to the open configuration.

In still other embodiments, a method is disclosed for providing a window in a casing string at a location within a wellbore. The method may include configuring a casing section having an outer sleeve defining an outer window and an inner sleeve defining an inner window in a closed configuration whereby the inner window is rotationally misaligned with the outer window such that the outer window is substantially closed by the inner sleeve. With the casing section in the closed configuration, the casing section may be positioned at the location within the wellbore. The inner sleeve may be rotated with respect to the outer sleeve to move the inner window into alignment with the outer window.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates generally to providing a casing exit for a lateral borehole, and more particularly to systems and methods for providing a casing exit with little or no milling of the casing.

Figure 1:
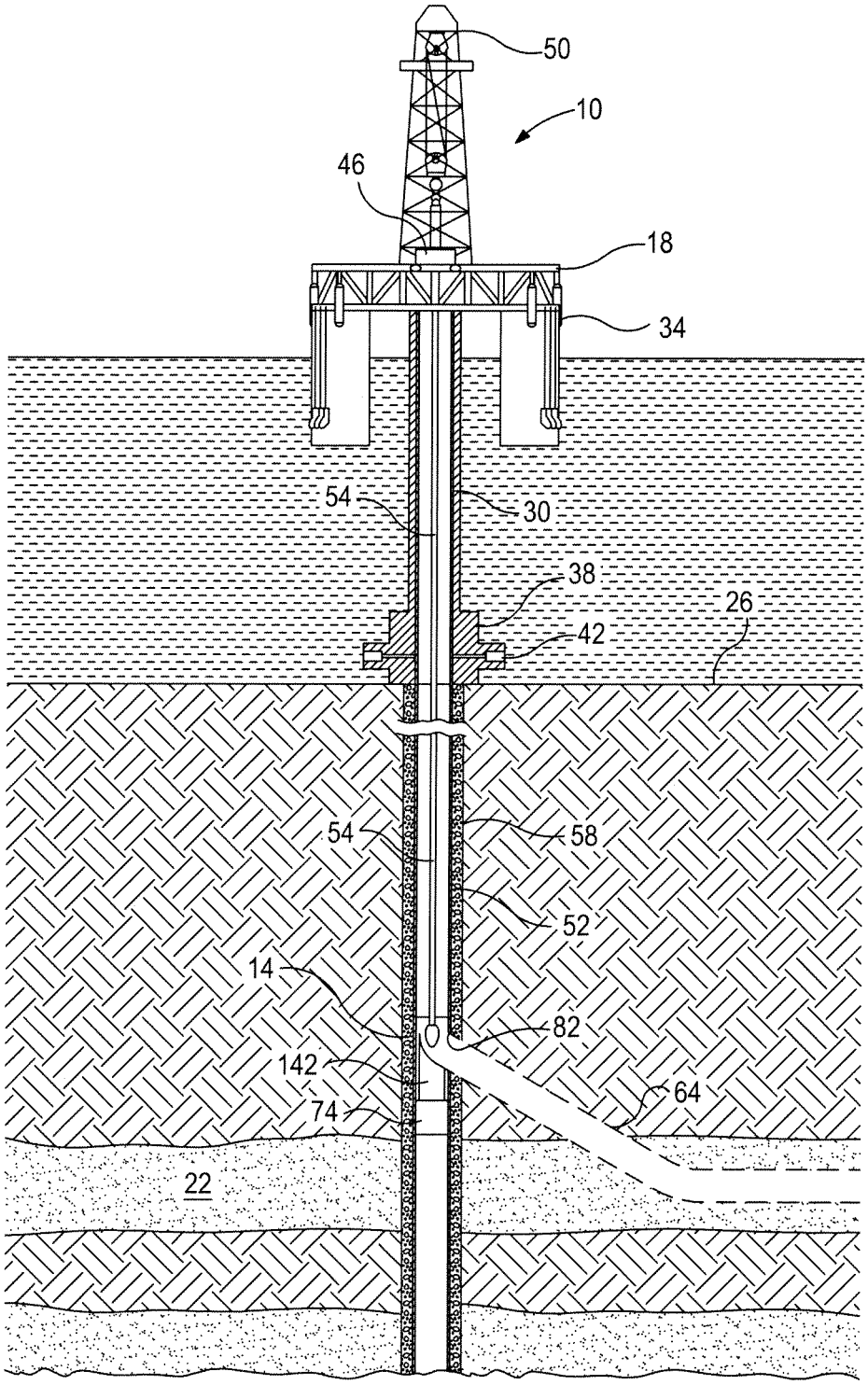
FIG. 1 is a schematic illustration of an offshore oil and gas platform using an exemplary rotatable window casing, according to one or more embodiments disclosed.

Referring to FIG. 1, illustrated is an offshore oil and gas platform 10 that uses an exemplary rotatable window casing section 14, according to one or more embodiments of the disclosure. Even though FIG. 1 depicts an offshore oil and gas platform 10, it will be appreciated by those skilled in the art that the exemplary rotatable window casing section 14, and its alternative embodiments disclosed herein, are equally well suited for use in or on other types of oil and gas rigs, such as land-based oil and gas rigs or any other location. The platform 10 may be a semi-submersible platform 18 centered over a submerged oil and gas formation 22 located below the sea floor 26. A subsea conduit 30 extends from the deck 34 of the platform 18 to a wellhead installation 38 including one or more blowout preventers 42. The platform 18 has a hoisting apparatus 46 and a derrick 50 for raising and lowering pipe strings, such as a drill string 54.

As depicted, a main wellbore 58 has been drilled through the various earth strata, including the formation 22. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 52, including the rotatable window casing section 14, is at least partially cemented within the main wellbore 58. The term "casing" is used herein to designate a tubular string used to line a wellbore. Casing may actually be of the type known to those skilled in the art as "liner" and may be made of any material, such as steel or composite material and may be segmented or continuous, such as coiled tubing. The rotatable window casing section 14 forms part of the casing string 52 and is positioned along the casing string 52 at a location where it is desired to create a lateral borehole or wellbore 64 (shown in phantom) that intersects the parent or main wellbore 58.

Figure 2:
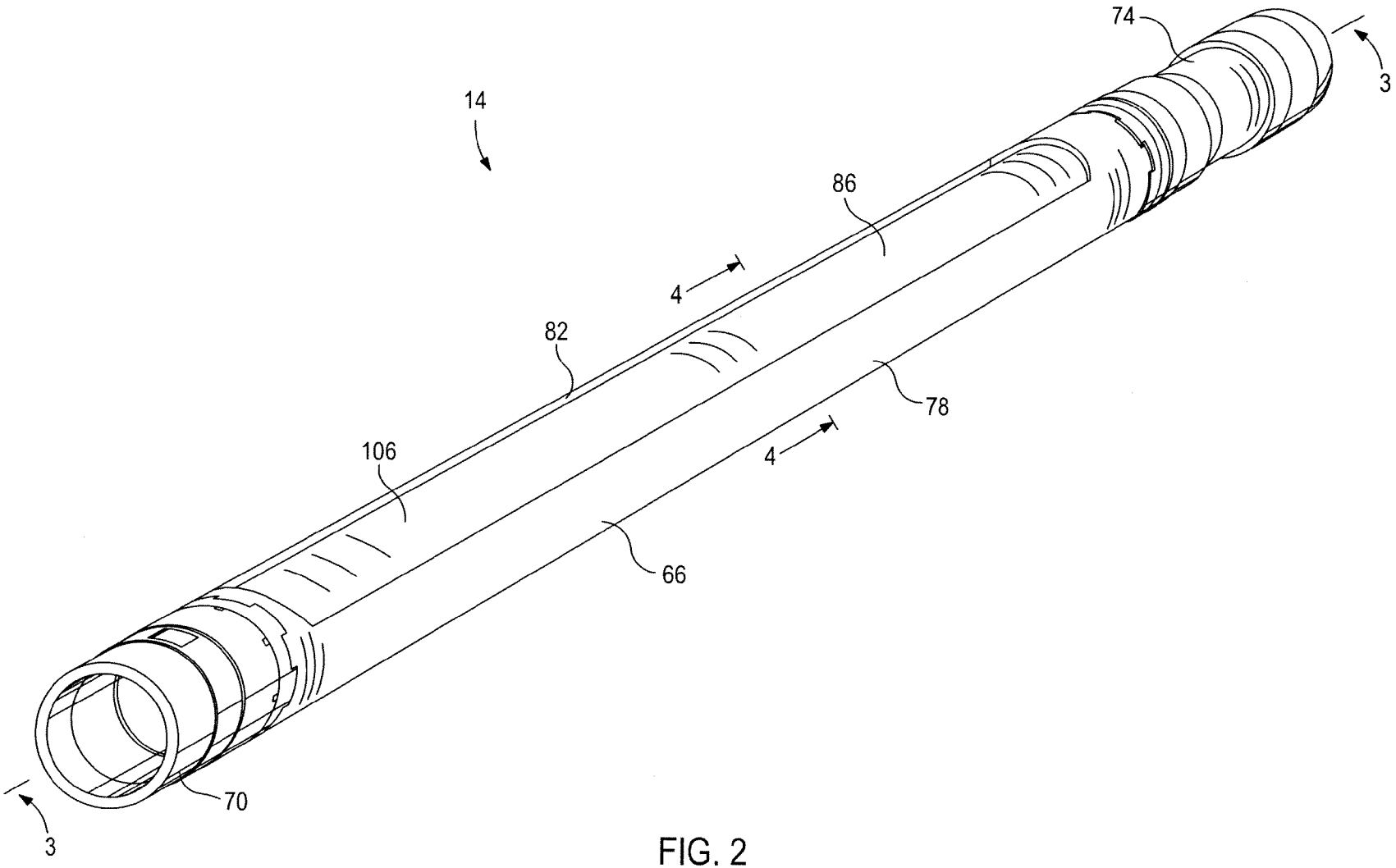
FIG. 2 is a perspective view of the rotatable window casing of FIG. 1 in a closed configuration.

Referring also to FIG. 2, the casing section 14 includes a generally cylindrical outer sleeve 66 including a proximal end 70 that, in the illustrated embodiment, is configured for coupling to uphole portions of the casing string 52, and a distal end 74. The distal end 74 may be coupled to additional downhole portions of the casing string 52 or may include a plug or other wellbore termination depending upon whether the main wellbore 58 continues beyond the casing section 14 or terminates substantially at the casing section 14. The outer sleeve 66 may be formed by a generally cylindrical outer sleeve wall 78. The outer sleeve wall 78 may be formed of steel, aluminum, composites, combinations thereof, or substantially any other suitable material or combination of materials. Once the casing section 14 is properly located within the main wellbore 58, the outer sleeve wall 78 remains substantially fixed with respect to the main wellbore 58. The outer sleeve wall 78 includes a pre-formed opening that defines an outer window 82. By "pre-formed" it is meant that the opening that defines the outer window 82 is formed in the outer sleeve wall 78 before the casing section 14 is introduced into the wellbore. In the illustrated embodiment, the outer window 82 is substantially rectangular and arcuate and extends generally from the proximal end 70 to the distal end 74 of the casing section 14.

Figure 3:
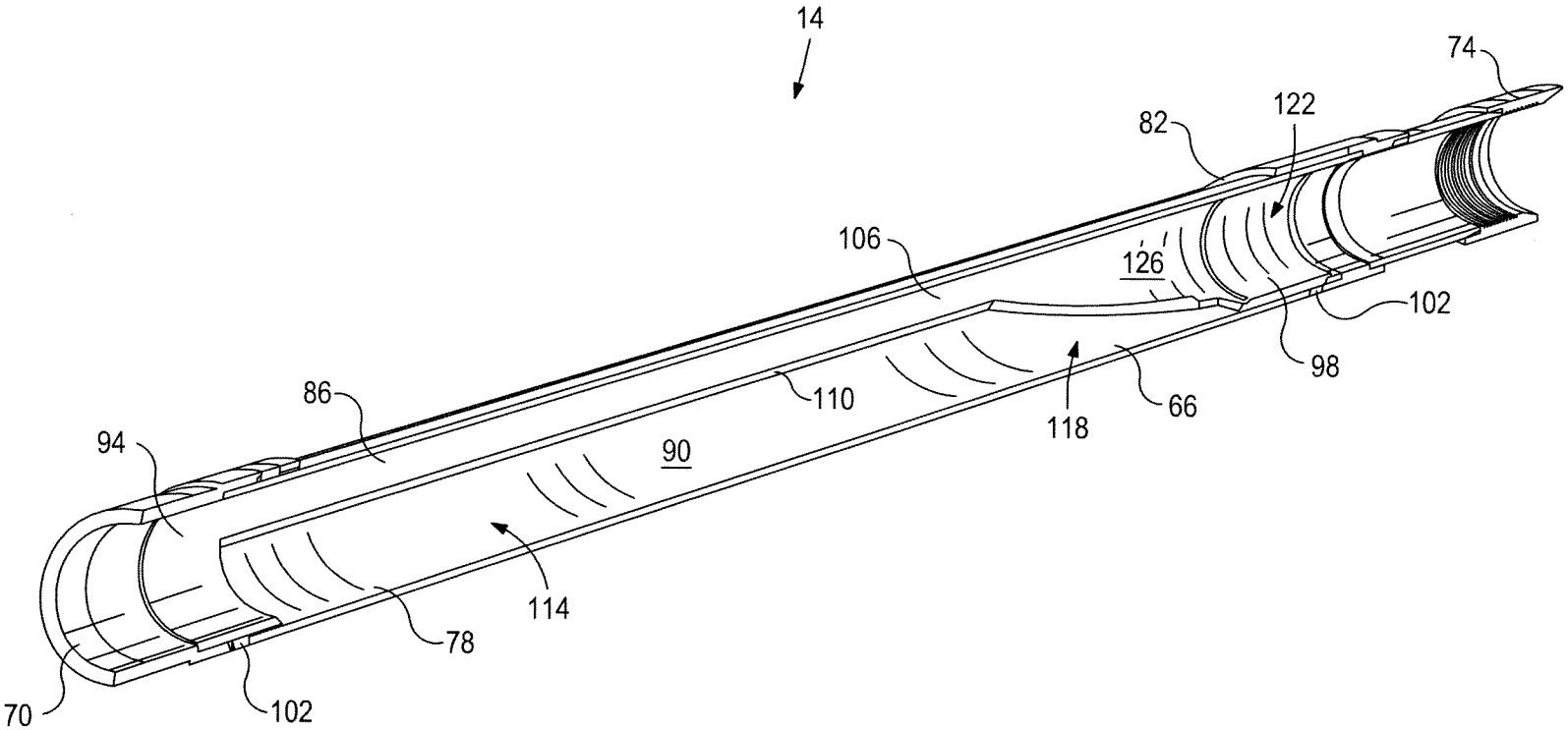
FIG. 3 is a section view taken along line 3-3 of FIG. 2.

Referring also to FIG. 3, the casing section 14 also includes a generally cylindrical inner sleeve 86 that is moveably received within the outer sleeve 66. In the exemplary embodiment of the drawings, the inner sleeve 86 is rotatable with respect to the outer sleeve 66. The inner sleeve 86 of the exemplary embodiment is closely received by and is in substantial mating engagement with an inner surface 90 of the outer sleeve wall 78. The inner sleeve 86 includes a proximal end 94 and a distal end 98 that are each rotatably coupled to the outer sleeve 66 by suitable seal and bearing assemblies 102. In the illustrated embodiment the bearing assemblies 102 permit rotational movement of the inner sleeve 86 with respect to the outer sleeve 66 while substantially preventing or limiting axial movement of the inner sleeve 86 with respect to the outer sleeve 66. In other embodiments, the inner sleeve 86 may also or alternatively be axially moveable with respect to the outer sleeve 66.

The inner sleeve 86 includes an inner sleeve wall 106. The inner sleeve wall 106 includes a pre-formed opening that defines an inner window 110. In the illustrated embodiment the inner window 110 includes a proximal portion 114 that is substantially rectangular and arcuate, and a tapered distal portion 118 having a substantially triangular or truncated triangular profile. It should be understood that the section view of FIG. 3 only shows substantially one-half of the inner window 110. FIG. 3 illustrates the casing section 14 in a first or closed configuration, where the inner window 110 does not communicate with or is otherwise not exposed to the outer window 82 (FIG. 2).

Figure 4:
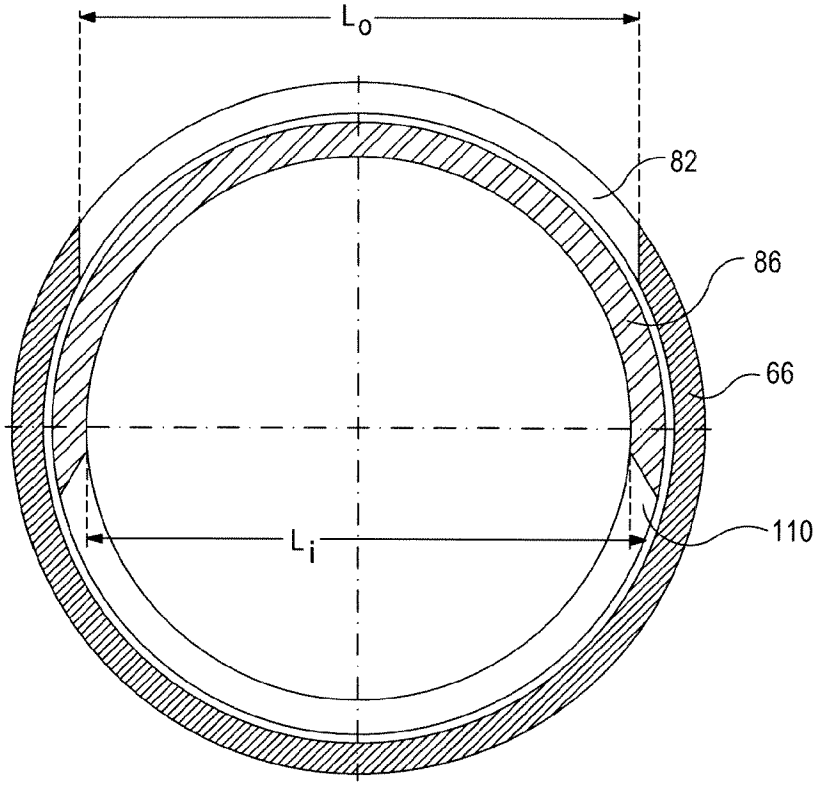
FIG. 4 is a section view taken along line 4-4 of FIG. 2.

For instance, as further shown in FIG. 4, when the casing section 14 is in the closed configuration, the inner sleeve 86 is in a first position in which the inner window 110 is misaligned with the outer window 82 of the outer sleeve 66. In the illustrated embodiment, when the inner sleeve 86 is in the first position the inner window 110 is substantially diametrically opposed to the outer window 82. With the casing section 14 in the closed configuration, the inner sleeve 86, and more specifically the inner sleeve wall 106, underlies and substantially closes the outer window 82. Because the outer window 82 is closed by the inner sleeve wall 106, material and debris located outside of the casing section 14 is generally unable to pass into the interior of the casing section 14, and vice-versa.

During formation of the main wellbore 58 and assembly of the casing string 52, the casing section 14 may be inserted into the casing string 52 at a desired location and advanced into the wellbore while in the closed configuration. When the casing section 14 is in the closed configuration, it can function in substantially the same manner as an otherwise standard section of casing or tubing within the casing string 52, thereby allowing the drill string and other equipment to be moved along and through the length of the casing section 14 in a substantially unrestricted manner until such time as it is desired to form the lateral borehole or wellbore 64 (FIG. 1). The casing section 14 is inserted into the casing string 52 and advanced along the wellbore 58 until it is located at a desired intersection of the lateral borehole 64 and the main wellbore 58, at which point the casing section 14 is cemented or otherwise secured within the wellbore 58.

Figure 5:
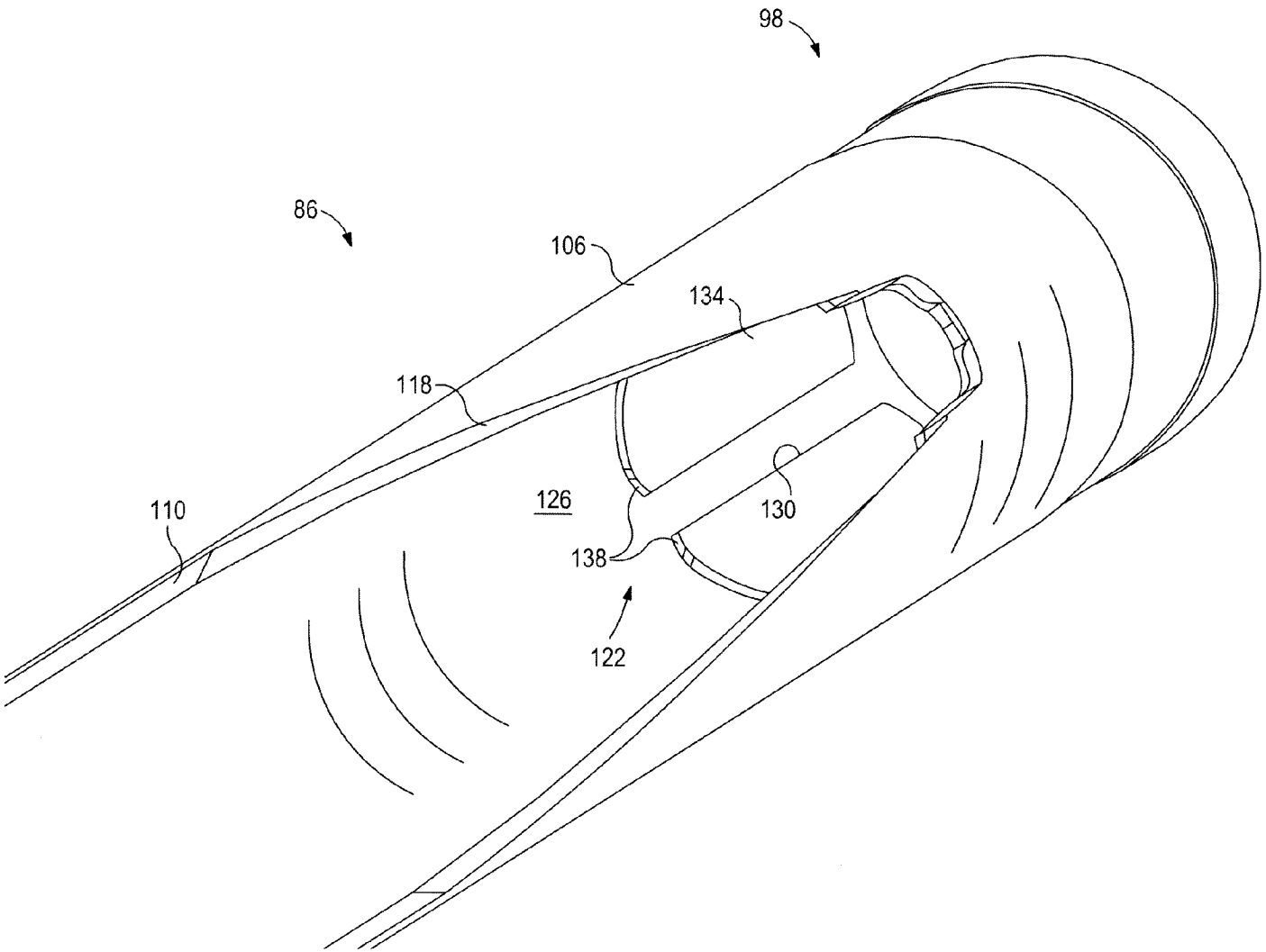
FIG. 5 is an enlarged perspective view showing an alignment portion of an inner sleeve of the rotatable window casing of FIG. 2.

Referring also to FIG. 5, the distal end 98 of the inner sleeve 86 includes an alignment portion 122 formed on an inner surface 126 of the inner sleeve wall 106. The illustrated alignment portion 122 may include an axially-extending slot 130 formed within a reduced-diameter portion 134 of the inner sleeve wall 106. Angled cam surfaces 138 may be positioned at a proximal end of the slot 130 and extend in a proximal and radial direction to function as alignment aids, as discussed further below. In other embodiments, the alignment portion 122 may be or include an aperture in the inner sleeve wall 106, a projection extending inwardly from the inner sleeve wall 106, a curved slot or curved projection that defines a more elongated cam surface 138, combinations thereof, and the like. Moreover, in still other embodiments the alignment portion 122 may be located at the proximal end 94 of the inner sleeve 86, or at substantially any location along the length of the inner sleeve 86.

Figure 7:
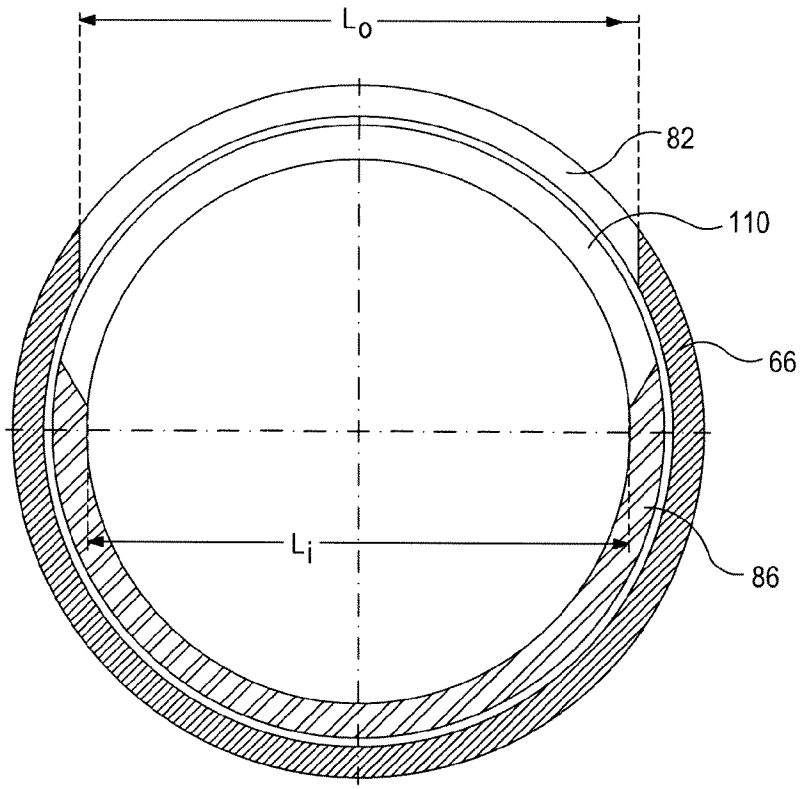
FIG. 7 is a section view taken along line 7-7 of FIG. 6.
Figure 6:
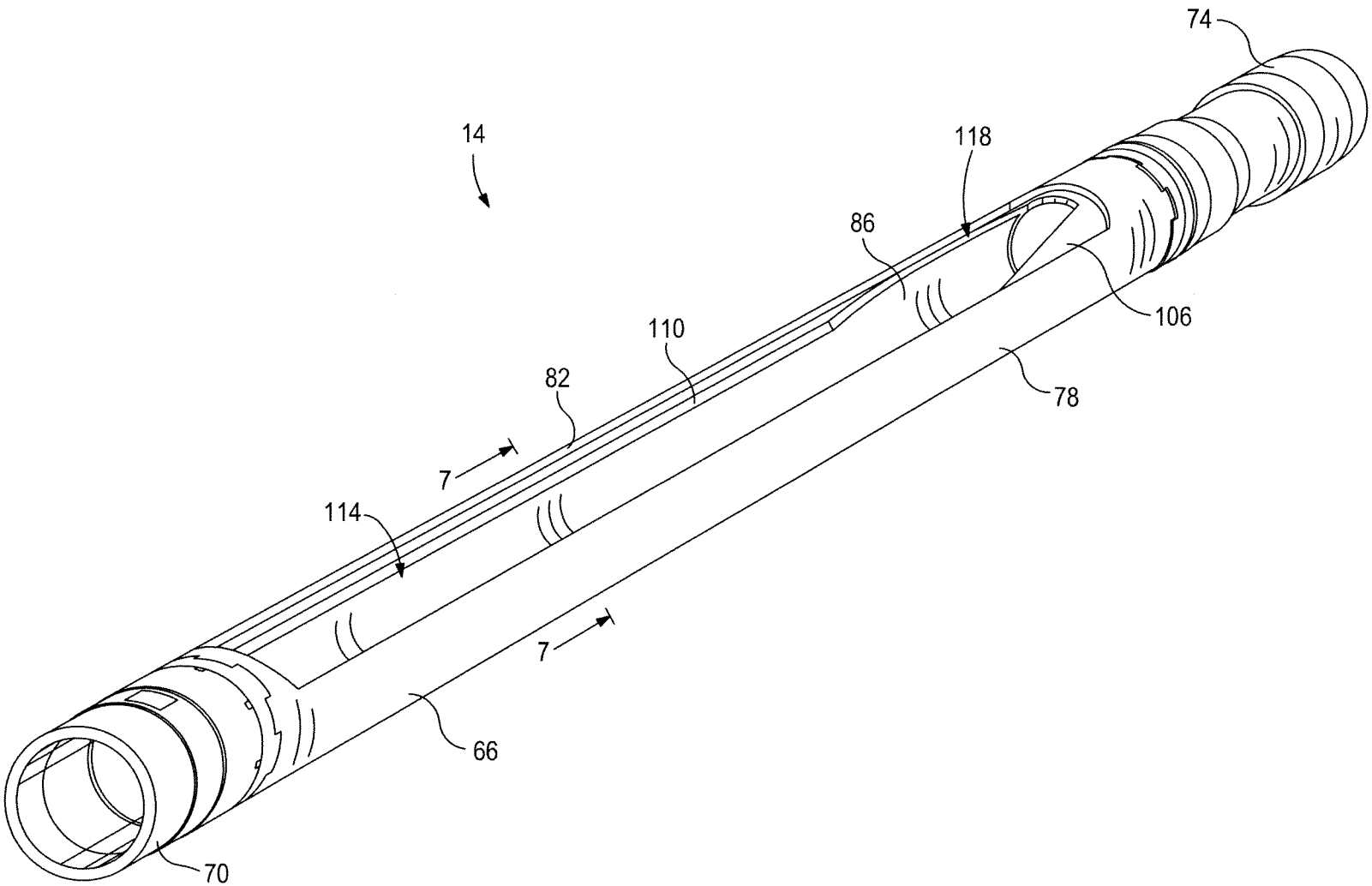
FIG. 6 is a perspective view of the rotatable window casing of FIG. 2 in an open configuration.
Figure 8:
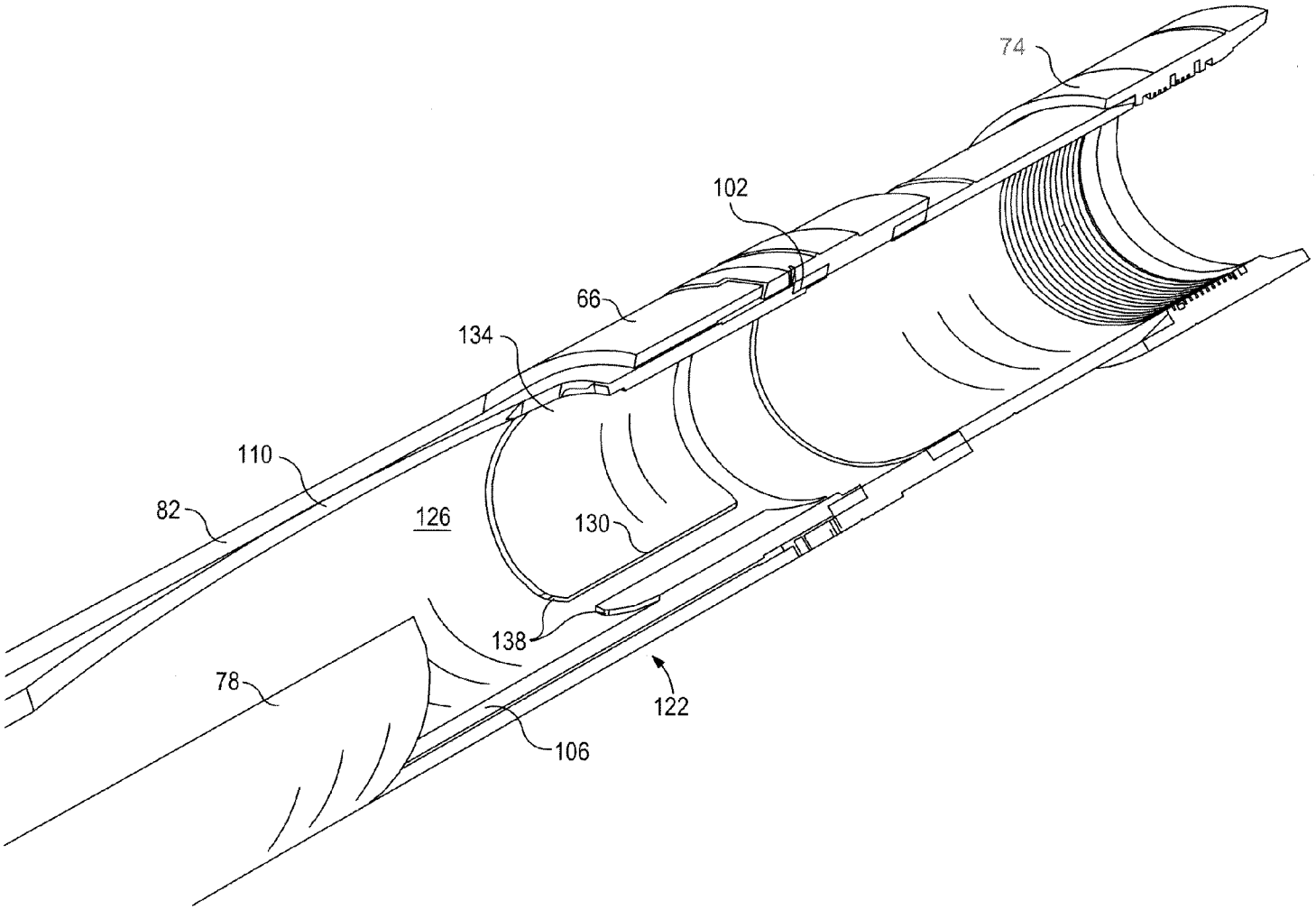
FIG. 8 is an enlarged section view similar to FIG. 3 with the rotatable window casing in the open configuration and showing the alignment portion of FIG. 4.

Referring now to FIGS. 6 through 8, the inner sleeve 86 is moveable, for example rotatable, with respect to the outer sleeve 66 from the first position of FIGS. 2 through 4 in which the inner window 110 is misaligned with the outer window 82 to a second position shown in FIGS. 5 through 7 in which the inner window 110 is substantially aligned with the outer window 82. When the inner sleeve 86 is in the second position, the casing section 14 is in a second, open configuration whereby the interior of the casing section 14 is exposed or opened to the exterior of the casing section 14. In this way, tools and other equipment can be guided or diverted out of the main wellbore and against the now exposed inner surface of the main wellbore 58 (see FIG. 1), for example to cut or otherwise form a lateral or secondary borehole or wellbore 64 that diverges away from the main wellbore 58. As shown, the size and shape of the inner window 110 is substantially similar to and generally compliments the size and shape of the outer window 82 to provide an elongated window or casing exit that extends along a substantial majority of the casing section 14. Generally speaking, the sizes of the inner window and the outer window 82 will be determined by the size of the system and the outer diameters of the mills and/or drill bits used to form the lateral wellbore 64. For example, a chord length Li (FIGS. 4 and 7) of the inner opening should be larger than the outer diameter of the largest mill or drill bit that will be used to form the lateral wellbore, and a chord length Lo (FIGS. 4 and 7) of the outer opening should be slightly larger than the chord length Li.

To move the inner sleeve 86 from the first position in which the casing section 14 is in the closed configuration to the second position in which the casing section 14 is in the open configuration, suitably configured equipment may be run down the casing string 52 to the casing section 14. Such equipment is provided with an alignment feature configured to engage with the alignment portion 122 provided on the inner sleeve 86. The equipment is then operated to apply a force to the alignment portion 122 that in turn causes movement, for example rotation, of the inner sleeve 86 with respect to the outer sleeve 66 until the inner sleeve 86 has been moved to the second position and the inner window 110 is brought into substantial alignment with the outer window 82.

Figure 9:
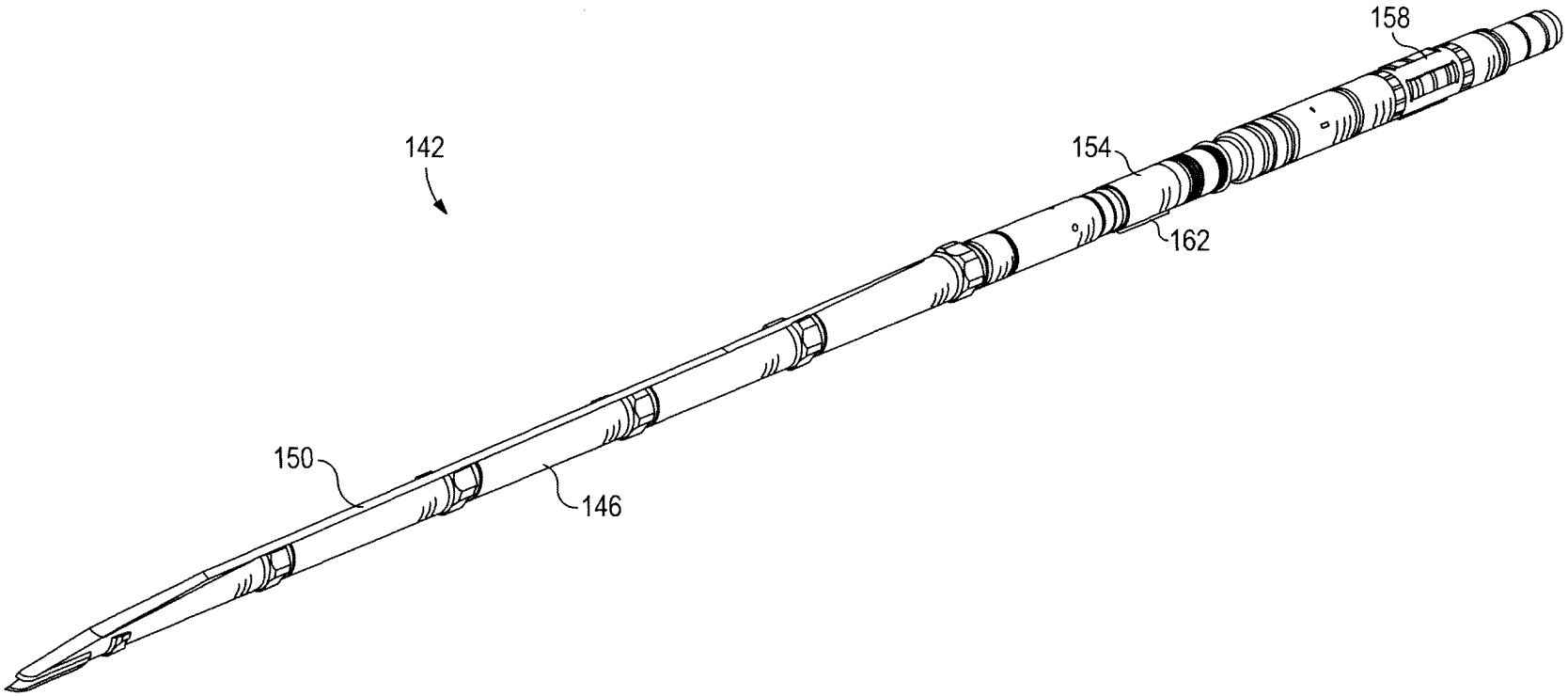
FIG. 9 is a perspective view of a deflector tool configured for use with the offshore oil and gas platform of FIG. 1 and the rotatable window casing of FIG. 2.

Referring also to FIG. 9, although substantially any type of down hole equipment can be used to adjust the casing section 14 from the closed configuration to the open configuration, in the illustrated embodiment, a deflector tool 142 in the form of a whipstock assembly may be configured to engage the alignment portion 122 of the inner sleeve 86 and thereby move the inner sleeve 86 from the first position to the second position. It should be appreciated that deflector tools 142 other than the illustrated whipstock assembly, such as a completion deflector, or a combination deflector that incorporates both a whipstock face and a completion deflector into one deflector face can also be utilized in combination with the casing section 14 and the general teachings and concepts discussed herein. At least one advantage of using the deflector tool 142 to move the inner sleeve 86 is that once the inner sleeve 86 has been moved and the casing section 14 is in the open configuration, the deflector tool 142 is already in position to deflect additional drilling equipment through the opened outer window 82 to begin drilling the lateral borehole 64.

The deflector tool 142 includes a proximal portion 146 that includes an angled deflector surface 150, an intermediate portion including a second alignment portion or alignment section 154 configured to engage the alignment portion 122, and distal latching portion 158 for fixedly engaging the distal end 74 of the outer sleeve 66. As can be appreciated, the deflector tool 142 is sized and configured to fit within the casing section 14.

Figure 10:
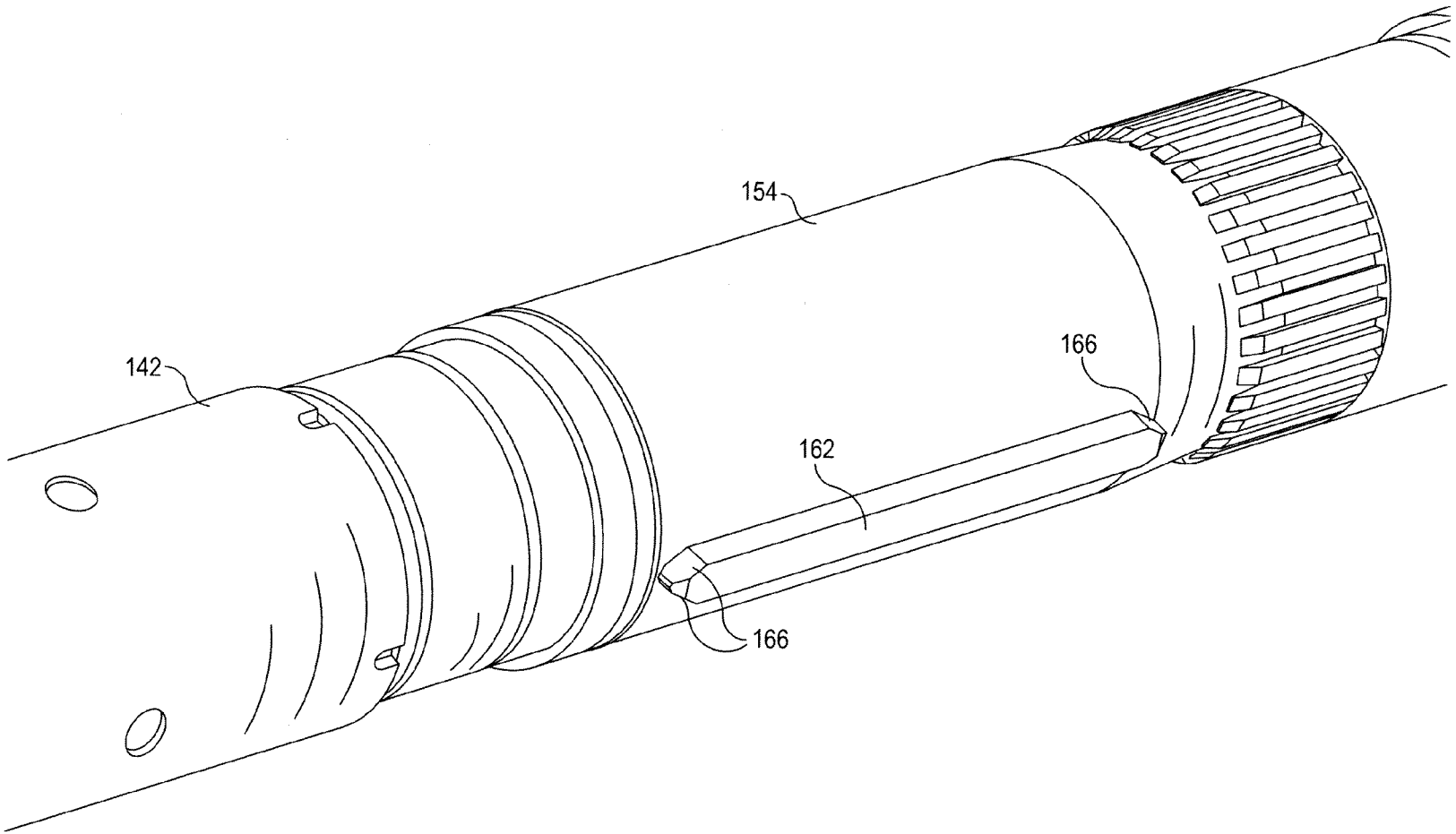
FIG. 10 is an enlarged perspective view of a portion of the deflector tool of FIG. 9.

Referring also to FIG. 10, one exemplary embodiment of the alignment section 154 includes an elongated and radially outwardly extending projection or lug 162 sized and configured to fit within the slot 130 of the alignment portion 122 of the inner sleeve 86 (see FIG. 5). The lug 162 may include angled lead-in surfaces 166 at each end that cooperate with the cam surfaces 138 (FIG. 5) of the alignment portion 122 to aid in rotational alignment of the inner sleeve 86 with the deflector tool 142 as the deflector tool 142 is advanced into the casing section 14. As best shown in FIG. 9, the lug 162 extends radially in a direction that is substantially diametrically opposed to the direction in which the deflector surface 150 faces. In other embodiments, the configuration of components may be reversed such that the alignment portion 122 of the inner sleeve 86 includes the lug 162 and the alignment section 154 of the deflector tool 142 defines the slot 130. Still other embodiments may include a more extensive arrangement of cam surfaces on one or both of the alignment portion 122 and the alignment section 154 such that axial movement of the deflector tool 142 into the casing section 14 engages the cam surfaces and causes the inner sleeve 86 to rotate from the first position to the second position. In still other embodiments, the lug 162 may be moveable between an extended position similar to the position illustrated in FIG. 10, and a retracted position whereby the lug 162 is substantially flush with the surrounding surfaces of the deflector tool 142. In such embodiments, once the deflector tool 142 is advanced to an appropriate location in the casing section 14, the lug 162 could be extended for engagement with or fitment within a suitably configured alignment portion 122 provided on the inner sleeve 86.

Figure 11:
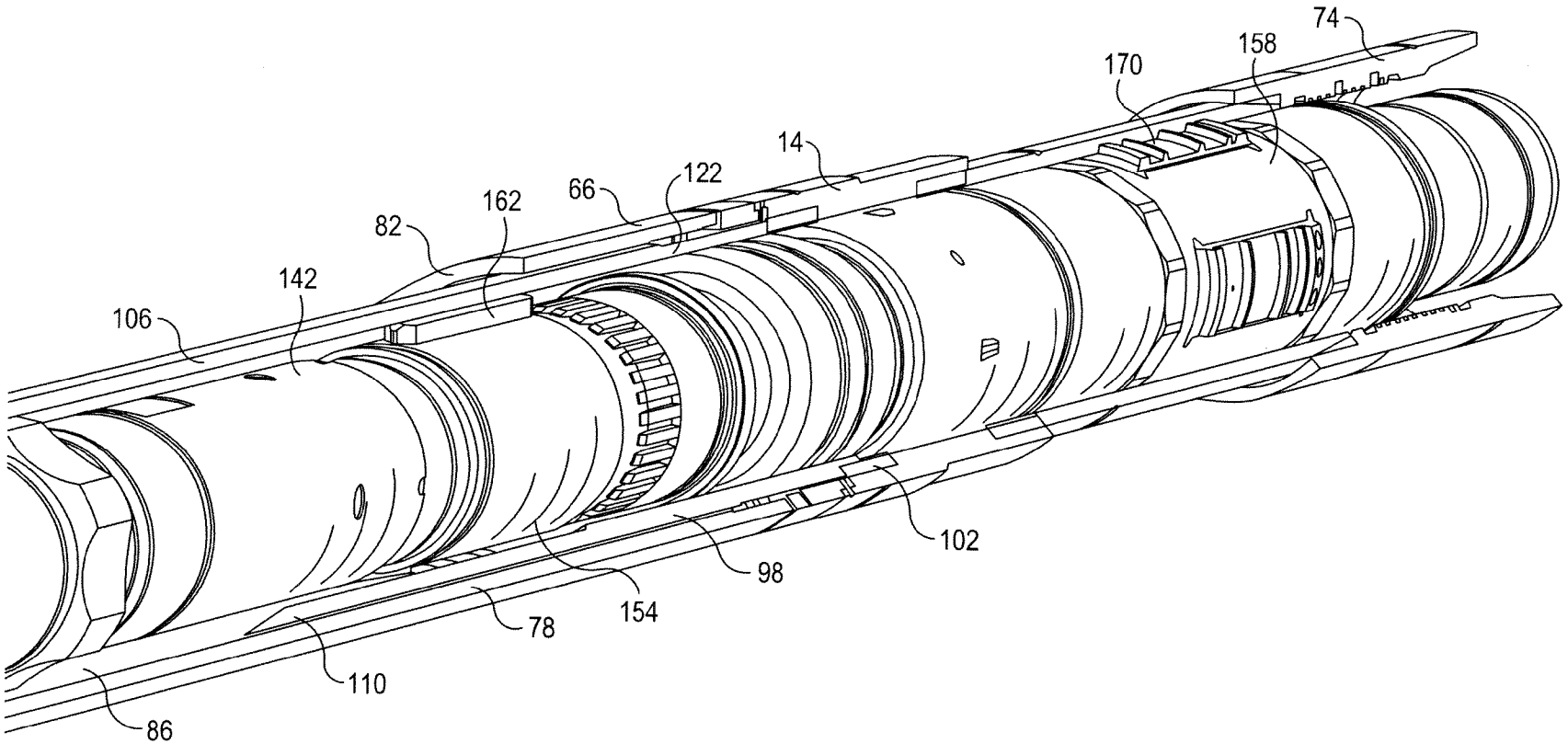
FIG. 11 is a perspective view showing the rotatable window casing of FIG. 2 in partial section, in the closed configuration, and with the deflector tool of FIG. 5 inserted therein.

FIG. 11 shows the deflector tool 142 axially advancing into the casing section 14 with the casing section 14 in the closed configuration. In the position shown, the lug 162 is still slightly uphole of the alignment portion 122 and the slot 130. The lug 162 is also substantially radially aligned with the location of the outer window 82 and substantially diametrically opposed with respect to the inner window 110. Although not shown, the deflector surface 150 is facing toward the inner window 110.

Figure 12:
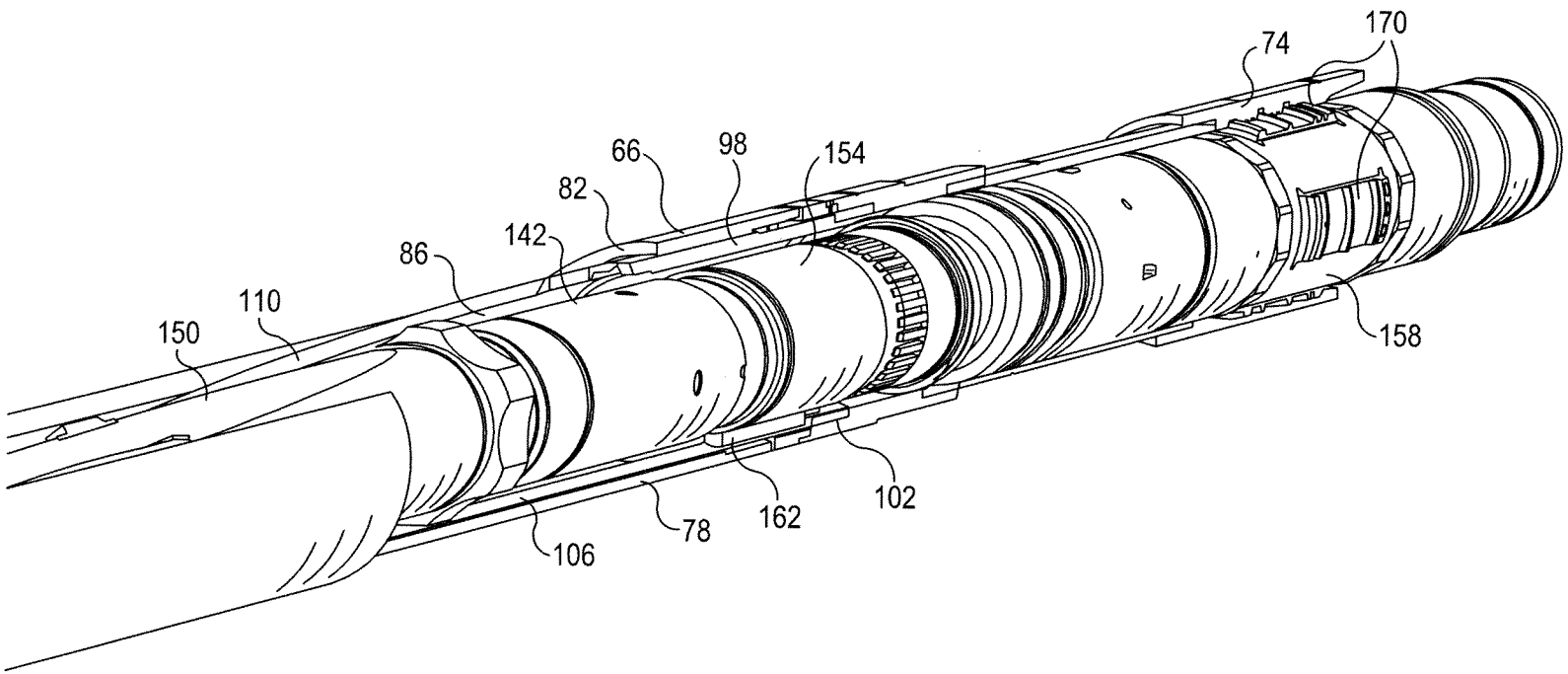
FIG. 12 is a perspective view similar to FIG. 11 where the deflector tool has been rotated and latched into position and the rotatable window casing has been moved from the closed configuration to the open configuration.

Referring now to FIG. 12, the deflector tool 142 has been axially advanced to insert the lug 162 into the slot 130 of the alignment portion 122. The deflector tool 142 has also been rotated about 180 degrees to move the inner sleeve 86 from the first position to the second position, thereby changing the casing section 14 from the closed configuration to the open configuration. As shown, the inner window 110 has been brought into substantial alignment with the outer window 82, and the deflector surface 150 is facing through the now opened inner and outer windows 110, 82. In alternative embodiments, one or both of the deflector tool 142 and the alignment portion 122 may be configured with an appropriate arrangement of cam surfaces such that as the deflector tool 142 is axially advanced into the alignment portion 122, the cam surfaces cause the inner sleeve 86 to rotate from the first position to the second position. In such alternative embodiments, the deflector tool 142 can be advanced into the casing section 14 with the deflector surface 150 facing toward the outer window 82. Still other embodiments may rely on a combination of cam surfaces and rotation of the deflector tool 142 to fully rotate the inner sleeve 86 from the first position to the second position.

In addition, latching cleats 170 on the latching portion 158 have been extended radially outwardly for engagement with the distal end 74 of the outer sleeve 66. In the illustrated embodiments, the latching cleats 170 may be extended after the deflector tool 142 has been rotated to move the inner sleeve 86 from the first position to the second position. In other embodiments the latching portion 158 may be rotatable with respect to the remainder of the deflector tool 142, in which case the latching cleats 170 may optionally be extended after the deflector tool 142 has been advanced axially into the casing section, but before the deflector tool 142 is rotated to move the inner sleeve 110 to the second position.

Figure 13:
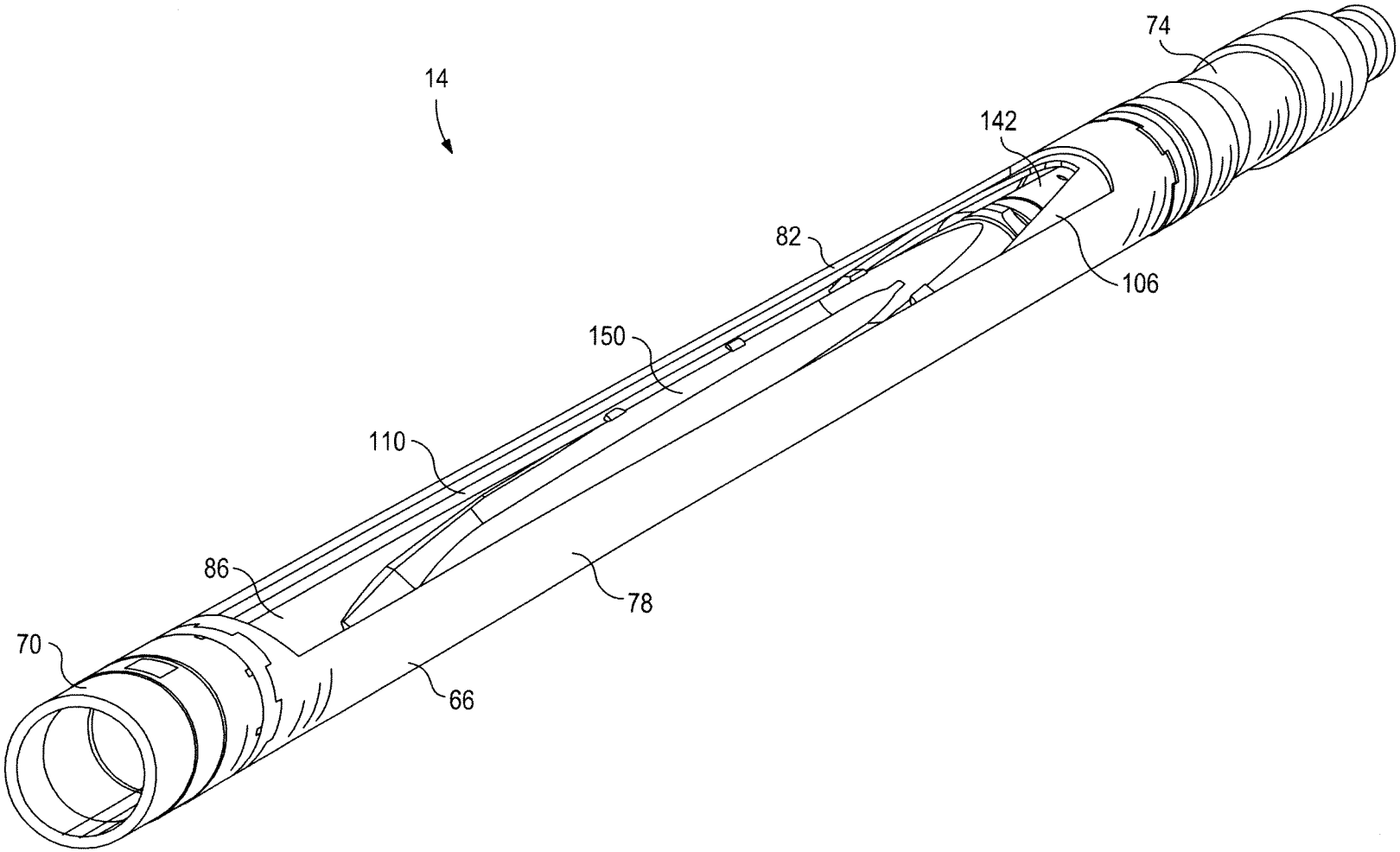
FIG. 13 is a perspective view showing the rotatable window casing of FIG. 2 in the open configuration with the deflector tool of FIG. 9 latched into position.

Referring to FIG. 13, when the casing section 14 is in the open configuration, the entire deflector surface 150 is substantially exposed to the exterior of the casing section 14. More specifically, the axial length of the inner and outer windows 110, 82 are greater than the axial length of the deflector surface 150. In this way, tools guided through the casing section 14 and into engagement with the deflector surface 150 may be diverted through the casing exit defined by the inner and outer windows 110, 82 and against the interior surface of the main wellbore to form or enter into an already formed lateral wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A casing section for positioning in a wellbore at a location where it is desired to form a diverging lateral borehole, the casing section comprising:

a generally cylindrical outer sleeve including a proximal end and a distal end, the outer sleeve defining an outer window extending between the proximal end and the distal end; and a generally cylindrical inner sleeve received within the outer sleeve and defining an inner window, the inner sleeve being moveable between a first position in which the inner window is misaligned with the outer window and the inner sleeve substantially closes the outer window, and a second position in which the inner window is aligned with the outer window, wherein the inner sleeve includes an alignment portion that defines an axially-extending slot having cam surfaces extending in a proximal and radial direction, the alignment portion being engageable to move the inner sleeve with respect to the outer sleeve.

2. The casing section of claim 1, wherein the inner sleeve is rotatable with respect to the outer sleeve from the first position to the second position.

3. The casing section of claim 1, wherein the alignment portion includes a slot.

4. The casing section of claim 1, wherein the outer sleeve includes a generally cylindrical outer sleeve wall, and wherein the outer window is defined by and extends through the outer sleeve wall.

5. The casing section of claim 1, wherein the inner sleeve includes a generally cylindrical inner sleeve wall, and wherein the inner window is defined by and extends through the inner sleeve wall.

6. The casing section of claim 1, wherein when the inner sleeve is moved to the second position, the outer window is opened and provides access to the wellbore for forming the diverging lateral borehole.

7. A drilling system for forming a lateral borehole that diverges away from a wellbore, the system comprising:

a casing string extended within the wellbore and including a casing section having an outer sleeve and an inner sleeve rotatably received within the outer sleeve, the outer sleeve including an outer sleeve wall defining an outer window that opens into the wellbore, the inner sleeve including an inner sleeve wall defining an inner window, the inner sleeve being rotatable with respect to the outer sleeve from a closed configuration in which the inner window is rotationally misaligned with the outer window and the inner sleeve wall substantially closes the outer window, to an open configuration in which the inner window is substantially rotationally aligned with the outer window, the inner sleeve including a first alignment portion engageable to rotate the inner sleeve with respect to the outer sleeve, wherein the first alignment portion includes a cam surface extending in a proximal and radial direction; and a deflector tool positionable at least partially within the casing section, the deflector tool including a deflector surface and a second alignment portion engageable with the first alignment portion to rotate the inner sleeve to the open configuration.

8. The drilling system of claim 7, wherein, when the deflector tool is positioned in the casing section, the second alignment portion engages the first alignment portion to rotate the inner sleeve to the open configuration.

9. The drilling system of claim 7, wherein the inner sleeve is axially fixed with respect to the outer sleeve.

10. The drilling system of claim 7, wherein the first alignment portion includes a slot, and the second alignment portion includes a projection.

11. The drilling system of claim 10, wherein the projection is moveable in a radial direction between an extended position and a retracted position.

12. The drilling system of claim 7, wherein when the second alignment portion engages the first alignment portion, rotation of the deflector tool causes rotation of the inner sleeve.

13. The drilling system of claim 7, wherein when the second alignment portion engages the first alignment portion, axial movement of the deflector tool causes rotation of the inner sleeve.

14. The drilling system of claim 7, wherein the second alignment portion is located distally of the deflector surface.

15. The drilling system of claim 7, wherein an axial length of the inner window is larger than an axial length of the deflector surface.

* * * * *